US008662790B2

(12) United States Patent
Phelps

(10) Patent No.: US 8,662,790 B2
(45) Date of Patent: Mar. 4, 2014

(54) SELF-FILLING MODULAR BARRIER

(75) Inventor: Simon Thomas Phelps, Broadstone (GB)

(73) Assignee: BU Innovations Limited, Bournemouth, Dorset (GB)

( * ) Notice: Subject to any disclaimer, the term of this patent is extended or adjusted under 35 U.S.C. 154(b) by 581 days.

(21) Appl. No.: 11/993,421

(22) PCT Filed: Jun. 26, 2006

(86) PCT No.: PCT/GB2006/050168

§ 371 (c)(1), (2), (4) Date: Jun. 10, 2008

(87) PCT Pub. No.: WO2007/000612

PCT Pub. Date: Jan. 4, 2007

(65) Prior Publication Data

US 2010/0150667 A1 Jun. 17, 2010

(30) Foreign Application Priority Data

Jun. 27, 2005 (GB) ..... 0512982.0
Jun. 22, 2006 (GB) ..... 0612390.5

(51) Int. Cl.
*E02B 7/10* (2006.01)
*F16B 13/00* (2006.01)

(52) U.S. Cl.
USPC ..... 405/111; 403/298; 405/114; 405/116

(58) Field of Classification Search
USPC ..... 405/107, 110, 111, 114, 116; 404/6; 256/13; 403/294
See application file for complete search history.

(56) References Cited

U.S. PATENT DOCUMENTS

| | | | | |
|---|---|---|---|---|
| 497,915 | A * | 5/1893 | Fulghum et al. | 403/294 |
| 2,279,942 | A * | 4/1942 | Hausherr | 256/13.1 |
| 2,867,160 | A * | 1/1959 | Wangerow | 404/66 |
| 3,357,146 | A * | 12/1967 | Gartrell | 52/592.4 |
| 4,064,672 | A * | 12/1977 | Faid et al. | 52/396.02 |
| 4,348,133 | A * | 9/1982 | Trent et al. | 404/6 |
| 4,869,617 | A * | 9/1989 | Chiodo | 404/6 |
| 5,470,177 | A * | 11/1995 | Hughes | 405/115 |
| 5,611,641 | A * | 3/1997 | Christensen | 404/6 |
| 5,882,140 | A * | 3/1999 | Yodock et al. | 404/6 |
| 6,059,491 | A * | 5/2000 | Striefel et al. | 405/111 |
| 6,517,277 | B2 * | 2/2003 | Hu et al. | 403/294 |
| 6,669,402 | B1 * | 12/2003 | Davis et al. | 404/6 |
| 6,764,247 | B1 * | 7/2004 | Kronenberg | 403/292 |
| 7,351,008 | B2 * | 4/2008 | Yodock et al. | 405/71 |
| 7,416,364 | B2 * | 8/2008 | Yodock et al. | 404/6 |
| 7,445,403 | B2 * | 11/2008 | Williams et al. | 405/107 |
| 7,708,492 | B2 * | 5/2010 | Carey | 404/6 |
| 7,866,913 | B2 * | 1/2011 | Kulp et al. | 404/6 |
| 2004/0156680 | A1 * | 8/2004 | Gibbs | 405/15 |
| 2004/0190993 | A1 * | 9/2004 | Archer-Simms et al. | 405/110 |
| 2007/0077123 | A1 * | 4/2007 | Williams et al. | 405/107 |

FOREIGN PATENT DOCUMENTS

WO WO2004/099509 A1 * 11/2004

* cited by examiner

*Primary Examiner* — Tara M. Pinnock
(74) *Attorney, Agent, or Firm* — Rankin, Hill & Clark LLP

(57) ABSTRACT

A flood barrier comprises hollow self-filling units (10, 12, 14, 16) placed end-to-end and connected at their ends by downwardly tapered bilobal (46) keys inserted into sockets (26, 28) at the ends of the units, wherein the keys incorporate concrete or other ballast for negative buoyancy.

15 Claims, 7 Drawing Sheets

SELF-FILLING MODULAR BARRIER

FIELD OF THE INVENTION

The present invention provides modular barrier apparatus for protecting households or premises from flood damage or to provide a barrier for the containment of fluids. The barrier is simple, easy and rapid for users to assemble and it can be used in a number of scenarios without the need for in-situ preparation. It is based on modular units for assembly in end-to-end abutting relationship and connectable using slide-in keys to create a flexible watertight barrier.

BACKGROUND TO THE INVENTION

Globally flooding is becoming more and more frequent due to climate change and the increase in development on flood-plain. Nearly 2 million properties are situated in flood risk areas within the UK. It is estimated that flooding has the potential to inflict damage to assets of over £200 billion. Some evidence of this can be seen in 2000, when insurance claims regarding flood damage were as high as £800 million.

Over 5% of people in England live lower then 5 meters above sea level. These locations are susceptible to frequent flooding. It has also been suggested that about 7% of the country is likely to flood at least once every 100 years from rivers. In addition, 1.5% of the country is at risk from direct flooding from the sea. Insurance companies charge huge sums to insure properties against flooding. In many instances they are not willing to insure a property at all, if located on a flood plain and at risk from regular flooding.

A number of flood defence products are currently on the market. However, only a handful of these carry the relevant kite mark relating to flood defence.

Sandbags still remain the most common method for protection and have the advantage that contours can be met, whether it is spanning a gap or assembling a defensive wall around a number of buildings. However thy have number of disadvantages, which include the following:

- Time-consuming to assemble into barriers.
- Prone to leakage.
- Viral and bacterial infections are often present in flood water and can in turn be transferred onto used sandbags.
- Large amount of material required to form a defensive wall.
- Large amount of manpower required to assemble a barrier in sufficient time.

The lengthy time needed to assemble a sandbag barrier and the manpower requirements significantly reduce the chances of a defence being erecting in time to protect against rising flood waters.

A product called Rapidam made by Flood Guards International has been displayed on Tomorrows World, where it received an award for innovation. It has been produced in a free-standing version which does not require in situ preparation, but a substantial time is needed for establishing a watertight seal and in use the resulting barrier requires a large number of sandbags.

Another product called Aqua-Barrier (Aqua Barrier International Limited) is based on a modular design and is portable and easy to deploy. It employs a linkage system that forms a watertight seal when in contact with water. However, the barrier requires in situ preparation in the form of bolts in the ground, and requires a considerable workforce to move the units into place.

GB-A-0600582 (Rowbotham) was concerned with the problem of flood protection and aimed to improve on simple banks of earth or other loose spoil which were stated not only to be laborious to construct but also to require time for settlement before they were fit for use. The proposed solution was to provide prefabricated segments which were capable of being assembled to form a bank and/or to be moved so as to enable an existing bank to be rapidly and easily re-erected on a new site. The prefabricated segments were of molded concrete and each comprised a base, a front, and two side walls, each of the side walls being formed on its outer face with a shoulder which extended from the crown to the base of the segment. One of the shoulders was arranged to face forwardly of the segment whereas the other shoulder was arranged to face rearward of the said segment. Thus by arranging a number of the segments in side-by-side relationship with their fronts in alignment, the rearward facing shoulder of each segment overlapped the forwardly facing shoulder of an adjoining segment, and a substantially watertight barrier was easily and quickly erected.

GB-A-2269618 (Tavner) disclosed a temporary anti-flood barrier comprising a water-filled wall formed by a combination of standard segments each consisting of a box section rectangular body of resilient rubber. The water filled wall was stabilized by fins built into the wall segments and by metal ribs and brackets externally on either side of the segments. A rubber under-mat formed an underseal. The wall was filled e.g. with mains water that flowed from segment to segment via water connector tubes.

GB-A-2364730 (Stuart) disclosed a portable flood barrier comprising a plurality of interlocking rubber panel segments held together at their ends by means of male/female connectors and locking arms that lock ed on to studs provided on an adjacent segment. The flood barrier was held in position by suction pads provided at the base of the segments and held in a vertical orientation by means of bracing arms.

GB-A-2397606 (Edler) disclosed a movable flood barrier comprising a watertight wall, a tank connected to the wall and an inlet in the tank for receiving water. The inlet and at least a portion of the tank were located below the top of the watertight wall. The tank could form an integral part of the wall such that the flood barrier had a substantially triangular cross-section. The base of the tank could be formed from reinforced sheeting which molded to the surface on which the tank is positioned. An air vent 4 and 5 may be provided above the level of the inlet to allow air to escape from the tank as flood water enters the tank though the inlet. Either end of the wall may be provided with means (14 and 17, FIG. 3) to connect water tightly to the end of another removable flood barrier.

GB-A-2398331 (Drury) disclosed a flood barrier unit comprising a tank formed of resilient material and having opposed front and rear walls with adjoining side walls and a base. The front wall had one or more openings at a low level to permit the inflow of water while the rear and side walls were watertight. The side walls were also shaped to co-operate with a side wall of another such unit to assist in forming a watertight seal. The base was elastic and/or flexible to conform closely to the ground under the loading provided by water in the tank. The tank could be formed as a prismatic shape with trapezoidal or triangular side walls narrower at the top than at the base. Each side wall could have a protruding section such as a generally upright corrugation or rib or a complementary recess to receive such a section.

U.S. Pat. No. 5,623,573 (Baker) disclosed a wall-like structure for flood protection, swimming pools, watering ponds for animals or other water containment purposes made of wedge-shaped plastics segments that could be coupled together to make a dam or supporting wall for containment of liquids and which found their weight by filling with water or other liquid.

US-A-2004/0190993 (Archer-Simms et al; see also WO 02/011154) disclosed a liquid barrier assembly for the prevention of flow of liquid from one area to an adjacent area The assembly comprised a plurality of hollow segments each of a plastics material e.g. polyethylene or polypropylene and each defining a substantially rigid chamber. Each segment was formed with a front concave wall against which, in use, liquid was intended to be incident. The front wall of at least one of the segments had a plurality of apertures that allowed the passage of liquid into and out of the chamber. Adjacent segments were corrected to one another in a side by side relationship by an elongate connector of bilobal or "dog-bone" section.

SUMMARY OF THE INVENTION

The present invention provides a modular flood barrier that can protect households or premises from flood damage. It is simple and easy for users to assemble and can be used in a number of scenarios. No in situ preparation is required, the barrier being formed as units connected by slide-in keys to create a flexible watertight barrier. In an embodiment, the units have been designed to nest together, one upside down on the other, to minimize storage space when not in use.

In one aspect, the invention provides a flood or other water barrier comprising hollow self-filling units placed end-to-end and connected at their ends by keys inserted into sockets at the ends of the units, wherein the keys incorporate ballast for negative buoyancy.

The invention also provides a set or kit of units and keys for forming a water barrier as aforesaid.

The invention further provides, for use in a barrier as aforesaid, a bilobal downwardly tapered key defined by a hollow plastics body filled with concrete or other ballast.

The invention yet further provides, for use in a barrier as aforesaid, a self-filling hollow plastics barrier unit having ends for abutment with ends of adjoining units to form a barrier, the ends being formed with downwardly tapering sockets for receiving interconnection keys.

BRIEF DESCRIPTION OF THE DRAWINGS

How the invention may be put into effect will now be described, by way of example only, with reference to the accompanying drawings, in which.

DETAILED DESCRIPTION OF PREFERRED EMBODIMENTS

FIG. 1 is a general view of the major components that may be used to form a flood barrier according to the invention. These include a straight modular unit 10 shown in front and rear oblique views, a shorter or "spanning" modular unit 12, an inwardly-facing curved modular unit, an outwardly-facing curved modular unit 16 and a tapered universal key 18 for connecting adjacent units together. The units may be assembled together end-to-end to create a barrier to water ingress e.g. as a flood defense, for water containment e.g. to create a pool or pond and as a linear barrier e.g. to span a gap in a wall, in the latter case a small number of sandbags being used to provide a water-tight connection at either end of the barrier.

In one embodiment, which will be described in detail below, the barrier has a height of 500 mm, but it will be appreciated that other dimensions are possible, e.g. an overall height of 1 meter.

The modular units used in the present flood barrier may be made of molded plastics, rotational molding being a convenient process for articles such as the modular units used for the present barrier. In rotational molding, a pre-determined quantity of polymer powder is placed into a mould. With the powder loaded, the mould is closed, locked and loaded into an oven. Once inside the oven, the mould is rotated around two axes, tumbling the powder. The process is not centrifugal one and speeds of rotation are relatively slow, typically less than 20 rev/min. As the mould becomes hotter the powder begins to melt and stick to the inner walls of the mould, and melting of the powder gradually builds up an even coating over the entire surface. When the melt has been consolidated to the desired level, the mould may be cooled either by air, water or a combination of both, and the polymer solidifies to the desired shape, in this instance of a modular unit. When the polymer has cooled sufficiently to retain its shape and be easily handled, the mould can be opened and the modular unit can be removed. At this point powder can once again be placed in the mould and the cycle repeated. Materials which can be molded in this way include polyethylene, polypropylene, EVA and PVC, although for present purposes HDPE is preferred on the grounds of high stiffness, toughness and scratch resistance e.g. Icorene, available from ICO polymers. Although rotational molding is a preferred route, other techniques e.g. blow molding may also be used.

Figure 1A:
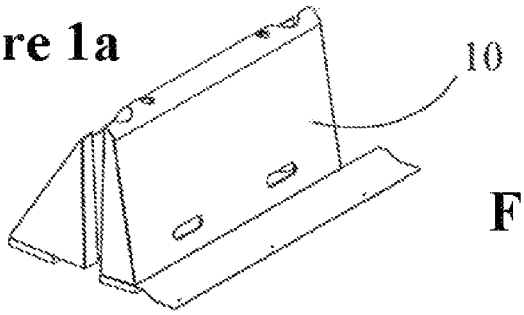
FIGS. 1*a*-1*e* are views showing major components of a flood barrier or device for holding a body of water according to the invention.
Figure 1B:
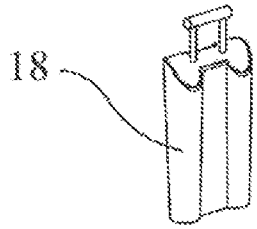
Figure 1C:
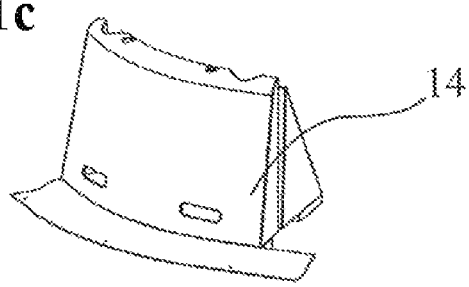
Figure 1D:
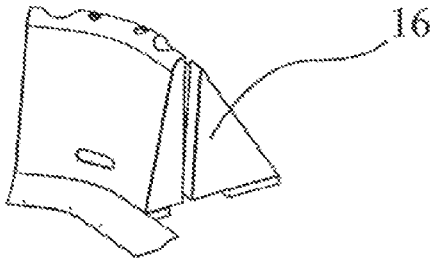
Figure 1E:
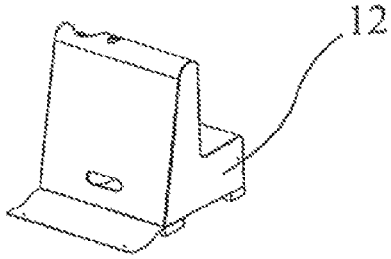
Figure 2A:
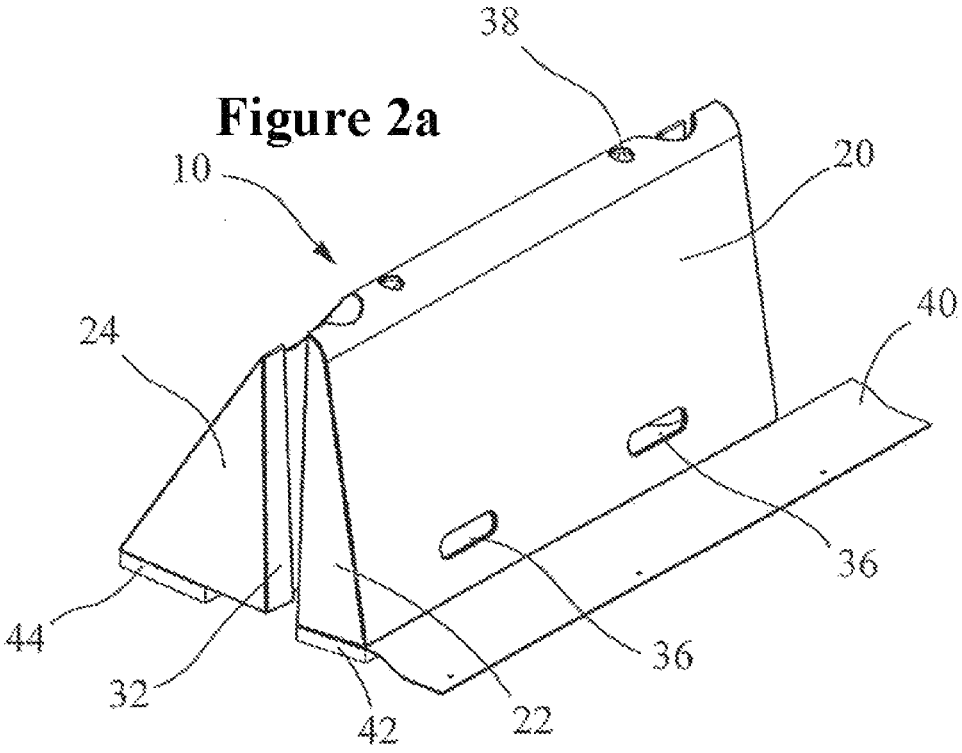
FIGS. 2*a*-2*b* are front oblique views of a straight modular unit for forming part of the flood barrier.
Figure 2B:
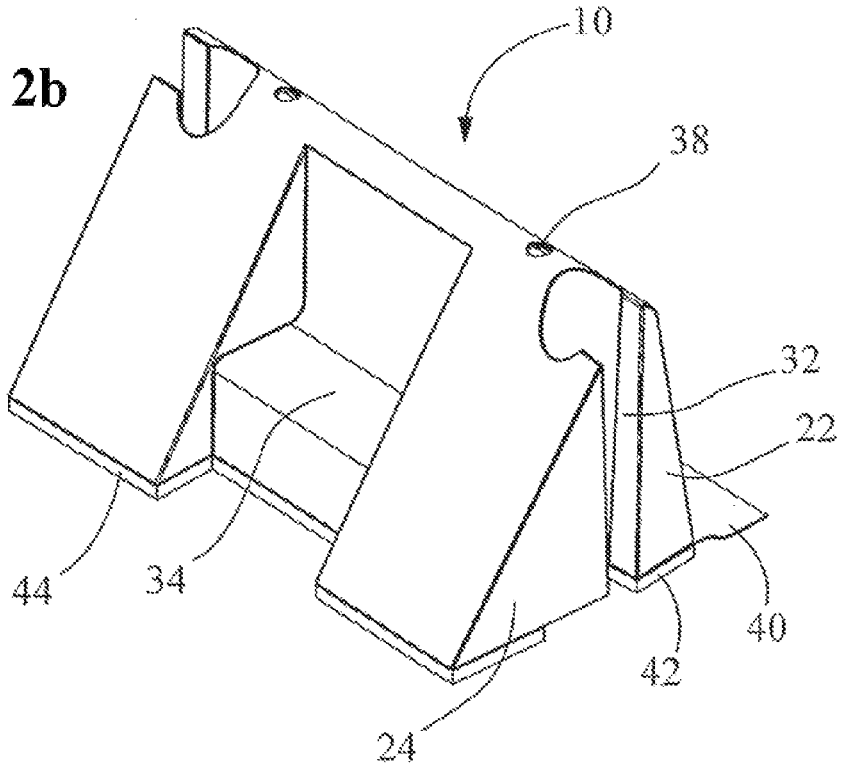
Figure 3A:
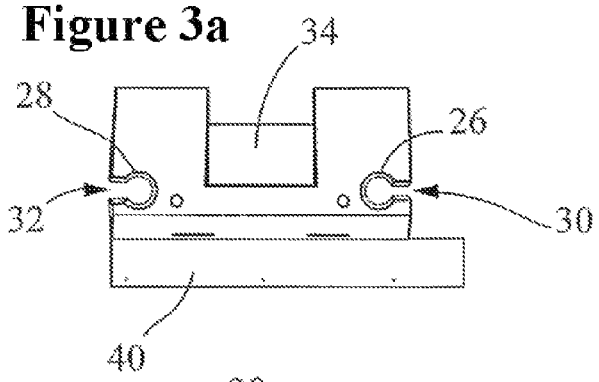
FIGS. 3*a*-3*c* shows the unit in plan and side views and FIG. 4 is a view of the unit from below.
Figure 3B:
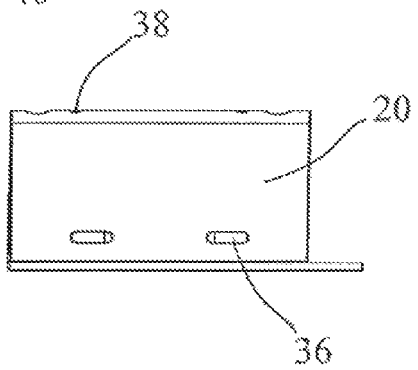
Figure 3C:
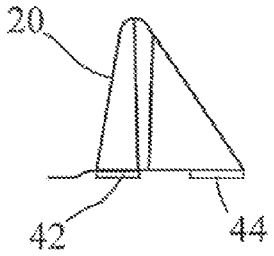
Figure 4:
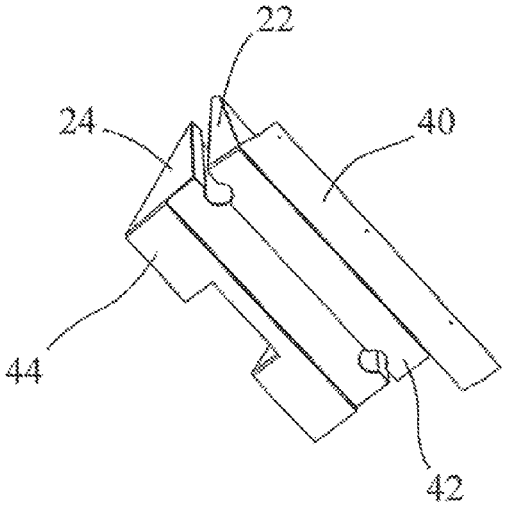
Figure 5A:
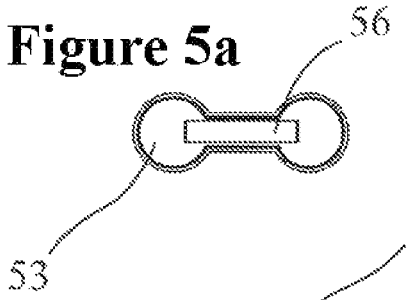
FIGS. 5*a*-5*c* and 6 are front and oblique views of a key for fastening together units of the flood barrier.
Figure 5B:
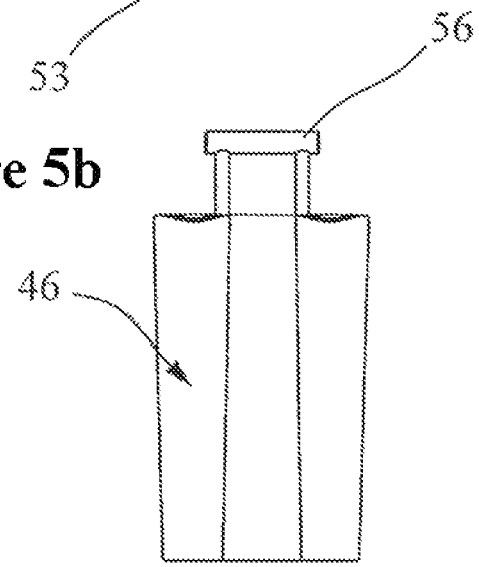
Figure 5C:
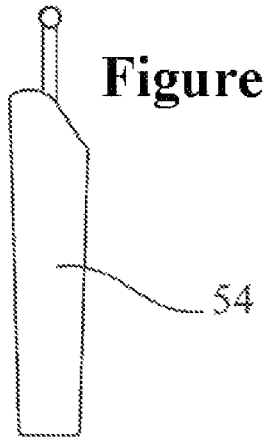
Figure 6:
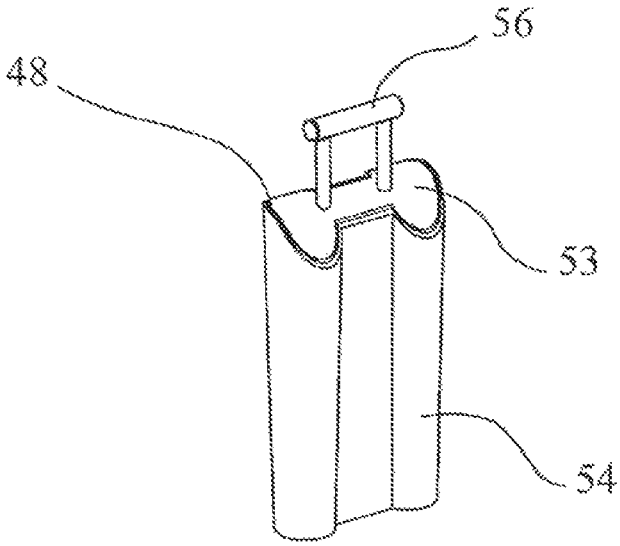
Figure 7:
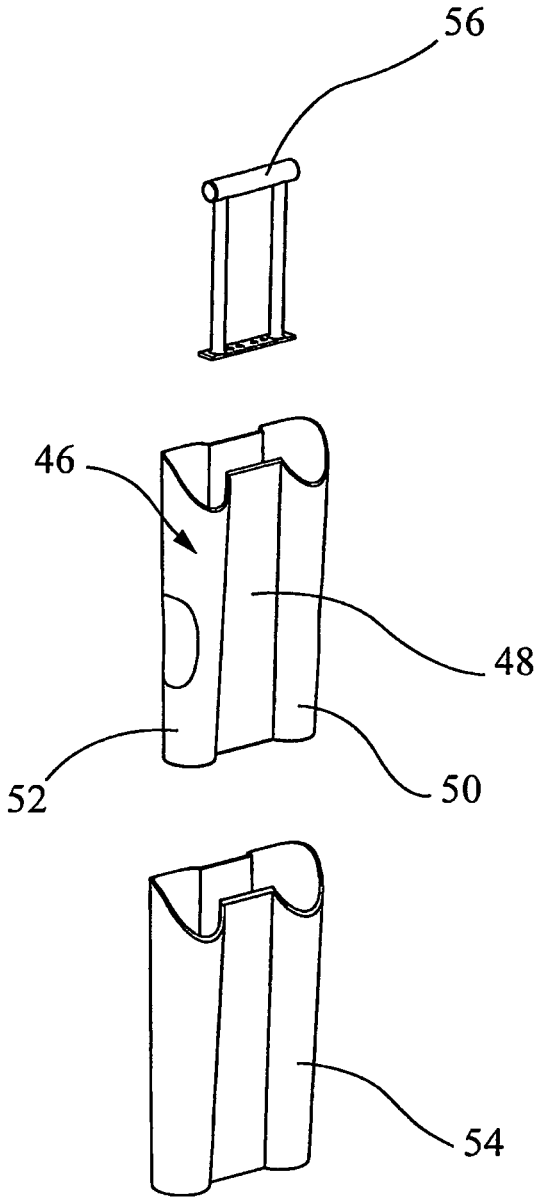
FIG. 7 is an exploded view showing the major components of the key.

Straight modular units 10 when viewed from the front may have an aspect ratio of about 2, their height being about 500 mm, their length being about 1000 mm and their wall thickness about 7 mm. The depth of the units approximately equals their height, in this instance also being 500 mm. The units each have a front wall 20 which slopes rearward at about 10° to the vertical and pairs of front and rear sidewalls 22, 24 each facing oppositely at about 4° to that front-to-back direction so as to give each sidewall in plan a slight protruding lozenge shape. With this shape, when adjoining units abut, the angle between them can be angularly adjusted within a small range of travel, in this instance ±4° to allow the barrier to follow a height contour in land. At the junction of sidewalls 22, 24, there are provided passageways 30, 32 leading to sockets 26, 28 tapering downwardly at a small acute angle, the angle of taper in this embodiment being 1.6°. The walls defining passageway 30 are in this embodiment parallel, whereas those in passageway 30 diverge in the direction of the side of the unit so as to permit a key inserted therein to be rotated through the above indicated small angular range of travel, in this instance ±4°. The rear of the unit is formed with a recess defining a horizontal ledge 34 for placement of local ballast e.g. a sandbag if required by flood conditions. Openings or self-filling holes 36 adjacent the base of front wall 20 and air release holes 38 at the top or crest of the unit admit water to the unit, so that as flood conditions are encountered, the water enters the unit and acts as ballast. FIG. 4 shows the sealing arrangements that are provided at the underside of the unit and that include a flexible front seal 40 of e.g. rubber matting about 3 mm thick and front and rear bottom seals 42, 44 spaced apart along the front and rear edges of the unit as shown and formed of a foamed material conveniently about 40 mm in height and e.g. of foamed NBR/PVC (Tec-O-Cel 400 low density sealing material available from Foam and Rubber Products lip of Wellingborough, Northants, UK). It will be understood that other foamed plastics materials e.g. a closed cell polyurethane foam may be used. The weight of the unit conforms the foam of the bottom seals 42, 44 to the contours of the ground and the flexible rubber seal 40 redirects flow of flood water to the self-filling holes 36 rather than to the bottom seals 40, 42. The front seal 40 and the bottom seals 42, 44 may be adhered to the polyethylene body of the unit by means of double-sided water-resistant adhesive tape or by an adhesive or cement known in the art. The front seal 40 is formed with holes by which it may be pegged down in soft ground. The internal volume of the unit is approximately 0.1 $m^3$ and its weight when not filled with any water is about 21 kg which is sufficiently low for the unit to be carried easily. In the example shown, the front edge has two self-filling holes 36 which can double as carrying handles.

The spanning modular units 12 and the inner and outer modular units 14 and 16 are similarly constructed, but of somewhat smaller overall dimensions and weight. The inner modular units have a convex front wall and the outer modular units have a concave front wall as shown.

The modular units do not themselves incorporate ballast and can therefore be manhandled by a single individual or in the case of larger units by a pair of individuals. Minimal ballast is required because the units are provided with internal cavities that can become filled with rising floodwater through the self-filling holes 36, which as previously explained double as handles.

Components of the tapered key are shown in more detail in FIG. 4. The key is based on a generally bi-lobal body 46 which is conveniently a rotational molding in HDPE of 3 mm wall thickness and has a relatively small straight central region 48 and tapered lobes 50, 52 for fitting into the sockets of adjacent units so as to interconnect them. A closed cell foam overmolding 54 e.g. of phenolic resin and of thickness e.g. about 5 mm is formed on and becomes strongly adhered to the exterior face of the key to give a watertight seal within the sockets of the modular units. Phenolic foam acts as a gasket but more importantly has good wear resistance, which is desirable as the keys may be used for assembly on a number of occasions. Concrete 53 is then poured into the body 46, after which handle 56 is set into it, giving a combined weight for the completed key of about 23 kg. The keys not only provide interconnection between the modular units of the barrier, but also they provide ballast so that the barrier as a whole has negative buoyancy and is not displaced by at least moderate speeds of flood water without the need for additional sandbags or the like. The further the keys are pushed into the sockets in the units that they are to connect, the stronger and more watertight the join that they make. Carrying and assembly/removal of the keys is facilitated by the built-in handle 56.

Figure 8:
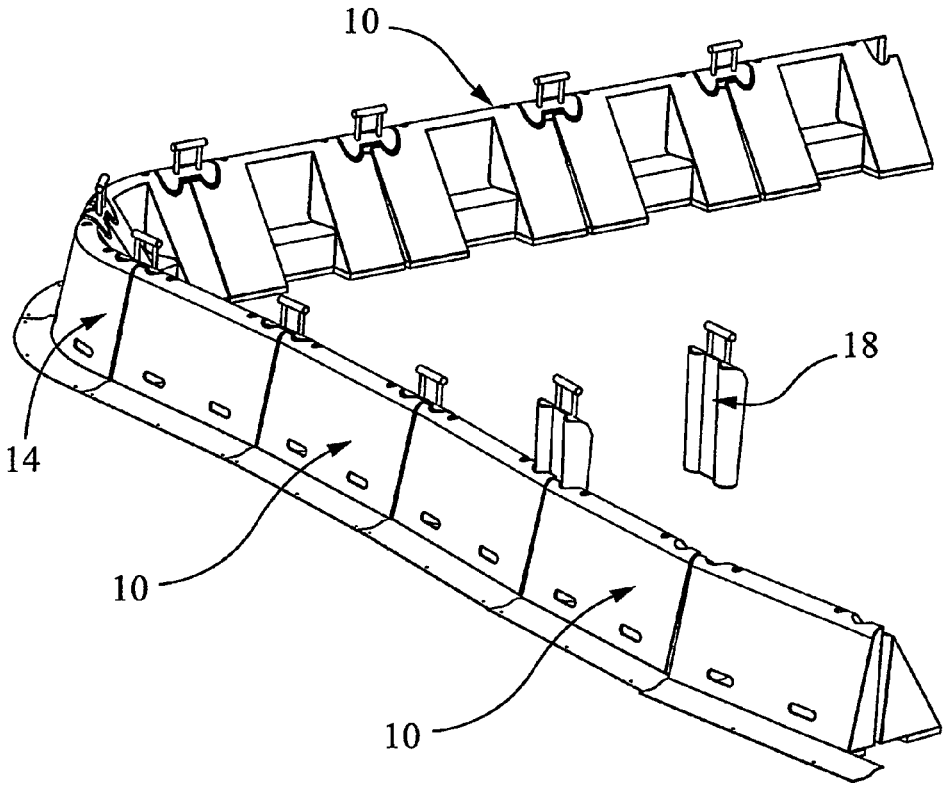
FIG. 8 shows part of an assembled barrier.

A flood barrier is readily assembled, as shown in FIG. 8, by positioning modular units end to end and connecting them with the keys described and in the present embodiment should be able to accommodate irregularities in ground contour of ±30 mm in height, though greater contour irregularities could be handled using thicker bottom seals 42, 44. If the flow of the flood is greater than 0.5 m/s extra ballast will need to be applied to the modular unit ledges 34. This can be in the form of anything to hand e.g. sandbags, sand, rubble etc. For example one or more sandbags or other local ballast may be placed on the ledge 34 of each unit. In real-life situations, it is uncommon for flood flows to be greater than 0.5 m/s, but this can happen e.g. when protecting against sea/tidal flooding, in which case the above mentioned additional ballast may be needed. The units of the barrier have approximately neutral buoyancy but when assembled using the concrete-filled keys the barrier as a whole is heavier than water and resists flood water through the weight of the concrete keys and the weight and mass of the water that fills each unit as the flood level rises. The barrier may be further weighted, as described above, to withstand faster-moving flood water.

Embodiments of the barrier have the features that they are

- Highly functional
- Assembled using only a small amount of manpower, and without extensive training
- Easy and rapid to assemble
- Useful on ground not previously prepared
- Flexible and able to match varying ground contours
- Inexpensive
- Formed of units that can nest together to assist storage. For example, in the case of the 500 mm high embodiment described above a 7.5 ton box van of load space dimensions 6 m×2.3 m×2.2.m can carry 240 of the straight modular units for transit.

The invention is applicable for a range of purposes in addition to flood protection, including containment of fluids, temporary containment for fish, containment of a cleansing pool for disease prevention, containment of a paddling pool, containment of sewage or toxic spills.

Figure 9A:
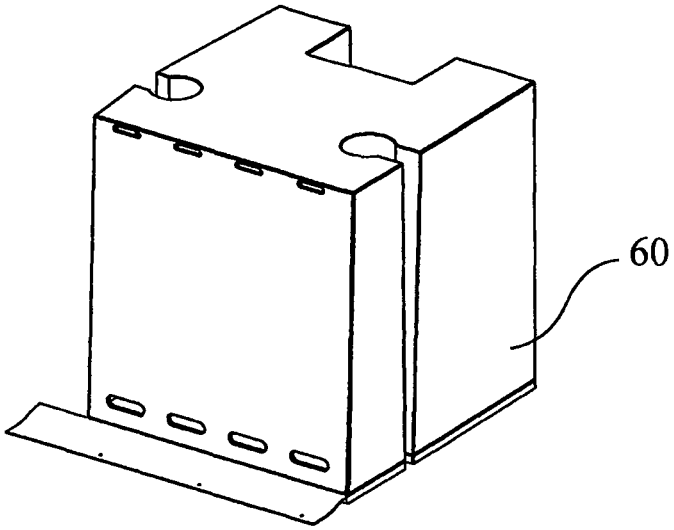
FIG. 9 shows straight modular units for a second embodiment of the barrier of greater overall height.
Figure 9B:
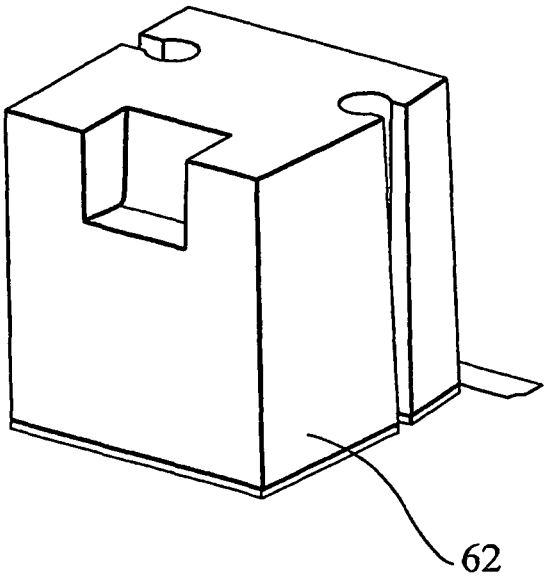

Various modifications may be made to the embodiment described herein without departing from the invention. For example, the body 46 could be extended upwardly to provide built-in handles, in which case the key after insertion could be filled locally with earth, stones or other locally available ballast. However this construction is not presently preferred because it would add to the work involved in erecting the barrier. FIGS. 9*a* and 9*b* are views of modular units for a barrier 1 meter high according to a second embodiment of the invention. Apart from their block-like shape to withstand the forces from the greater depth of flood water and increase the weight of water that enters the unit by the self-filling mechanism, they are essentially similar to the modular units of the previous embodiment and may be assembled and used in a similar way. Like the units of the previous embodiment, they each incorporate a shelf for placement thereon of a sandbag or other local ballast. The air release holes are located at the top of the each front face of each unit which allows the units to be stacked as well as assembled side by side, or to allow the lighter 500 mm units of the earlier embodiment to be stacked thereon giving barrier heights of 1.5 meters or 2 meters.

The invention claimed is:

1. A fluid-flow barrier comprising a plurality of hollow self-filling units and releasable interconnection keys, the units each having a body and openings provided in a front face to enable the units to be self-filling when fluid flows towards the front face of the units and enters the units via the openings, and the units each having a seal on the bottom surface of the respective unit, said seal being formed of a flexible material to provide a seal between the unit and the ground on which the unit is placed so that the flow of said fluid is contained by the barrier when said units are placed end-to-end such that one end of a first unit is adjacent one end of a second unit and connected at said ends by the interconnection keys that are inserted into sockets provided within end walls of the adjacent ends of the units, wherein said keys provide ballast for negative buoyancy to inhibit the barrier from being displaced by the flow of said fluid, said ballast being additional to ballast provided by fluid that enters the units via the openings in a front face of the units, said keys further including a gasket of flexible material that is formed on an outer surface of the key to provide a watertight seal within the sockets of the barrier units when the keys are inserted into the socket.

2. The barrier of claim 1 wherein the end walls of the units include a plurality of surfaces that are angled relative to each other to permit adjustment between adjacent units.

3. The barrier of claim 1, wherein said sockets are spaced from the end walls of the units and first and second passageways lead from the end walls into the sockets, walls defining the second passageway from one end wall of the unit being divergent to allow angular movement of the key.

4. The barrier of claim 3, wherein walls of the first passageway at the other end wall of the unit are parallel-sided.

5. The barrier of claim 1, wherein the sockets are downwardly tapered.

6. The barrier of claim 1, wherein the keys are of downwardly tapered bilobal profile.

7. The barrier of claim 1, wherein the keys have a hollow molded plastics body filled with ballast.

8. The barrier of claim 7, wherein the keys are ballasted with concrete.

9. The barrier of claim 7, wherein each key has a handle set into the concrete.

10. The barrier of claim 1 wherein the exterior of the unit is formed with plastics foam for water-tightness.

11. The barrier of claim 10, wherein the plastics foam is phenolic.

12. The barrier of claim 1 wherein said seal is comprised of front and rear seals placed along the front and rear edges of the bottom surface of each unit.

13. The barrier of claim 1 wherein said seal is formed of a foamed material having a thickness of 40 mm.

14. The barrier of claim 1 wherein said gasket is formed of a foamed material having a thickness of 5 mm.

15. A fluid-flow barrier comprising a plurality of hollow self-filling units and releasable interconnection keys, the units each having a body and openings provided in a front face to enable the units to be self-filling when fluid flows towards the front face of the units and enters the units via the openings, and the units each having a seal on the bottom surface of the respective unit, said seal being formed of a flexible material to provide a seal between the unit and the ground on which the unit is placed so that the flow of said fluid is contained by the barrier when said units are placed end-to-end such that one end of a first unit is adjacent one end of a second unit and connected at said ends by the interconnection keys that are inserted into sockets provided within end walls of the adjacent ends of the units, wherein said keys provide ballast for negative buoyancy to inhibit the barrier from being displaced by the flow of said fluid, said ballast being additional to ballast provided by fluid that enters the units via the openings in a front face of the units, said keys further including a gasket of flexible material that is formed on a surface within the sockets of the barrier unit and is arranged to provide a watertight seal within the sockets of the barrier units when the keys are inserted into the sockets.

* * * * *